US006173465B1

(12) United States Patent
Deneau

(10) Patent No.: US 6,173,465 B1
(45) Date of Patent: Jan. 16, 2001

(54) MATTRESS

(76) Inventor: Ronald Arthur Deneau, 7201 Cliff Pine Dr., Gaithersburg, MD (US) 20879

( * ) Notice: Under 35 U.S.C. 154(b), the term of this patent shall be extended for 0 days.

(21) Appl. No.: 09/515,664

(22) Filed: Feb. 29, 2000

Related U.S. Application Data

(62) Division of application No. 09/266,577, filed on Mar. 11, 1999, now Pat. No. 6,061,857.

(51) Int. Cl.[7] ..... A47C 27/00
(52) U.S. Cl. ..... 5/733; 5/495
(58) Field of Search ..... 5/731, 733, 735, 5/695, 482, 495, 496, 490

(56) References Cited

U.S. PATENT DOCUMENTS

| | | | |
|---|---|---|---|
| 254,759 | 3/1882 | Young | 5/731 |
| 965,637 | 7/1910 | Klimowicz et al. | 5/735 |
| 2,244,435 | 6/1941 | Simons | 5/725 |
| 3,967,335 | 7/1976 | Rhoads | 5/735 |
| 4,122,565 | 10/1978 | Hoben | 5/695 |
| 5,095,569 | 3/1992 | Glenn | 5/490 |
| 5,369,824 | 12/1994 | Powell | 5/735 |

*Primary Examiner*—Alexander Grosz
(74) *Attorney, Agent, or Firm*—Pillsbury Madison & Sutro LLP

(57) ABSTRACT

A hugging mattress and method of using, and a sheet therefore, the sheet having two walled slots or pockets extending transverse to the longitudinal axis of the mattress and preferably nesting within two corresponding holes in the mattress. The mattress holes go all the way through the mattress and are rectangular or oblong and situated near each end of the mattress at the approximate shoulder and thigh positions. The function of the holes is to extend the normal pleasures of a mattress to allow hugging one's bedmate for extended periods of time without the crushing weight one feels on his or her arm. The mattress can come with insertable plugs to make it a conventional mattress when the owner doesn't feel like hugging or when for safety such as when children may jump on a bed. The method of using the mattress including extending an arm of the user in a first hole in the mattress, then rotating the mattress 180° to enable the user to extend an arm into a second hole of the mattress.

15 Claims, 1 Drawing Sheet

MATTRESS

This application is a divisional application of application Ser. No. 09/266,577, filed Mar. 11, 1999 now U.S. Pat. No. 6,061,857, which is incorporated herein by reference.

BACKGROUND

Mattress used for sleeping have been made in more or less the same shape and in several sizes for many years. Functions like softness, firmness, longevity, and comfort have been touted in advertisements. Different materials like feathers, foam, coil springs, water and air have been invented and produced. All these past achievements have been directed at making mattresses more sleepable or functional. Prior art is found in Class 5, Subclasses 421, 690, 596, 192, etc. They all overlook the fact that bedmates would sometimes like to hug for extended periods, either head to head or head to toe, without having their arms fall asleep or get sore from the crushing weight of their bed partner. This invention, the HUGGING MATTRESS is intended to permit extended hugging of a person's bedpartner.

SUMMARY OF THE INVENTION

This invention includes the addition of two holes to any ordinary mattress design commonly used with a bed. The holes protrude entirely through the mattress, one being located in the region of a sleeper's shoulder and the other symmetrically placed on the opposite end of the mattress. The holes are preferably to be rectangular or oval 18 inches by 8 inches more or less and are for the purpose of allowing a person to wrap his lower arm around, or in other words to hug or embrace, his bed partner for extended time periods without the normal crushing that has always precluded this activity. The two symmetrically located holes permit the HUG MATTRESS to function when flipped or turned as is commonly recommended every several months and also permit hugging in the head to toe position. When not used for hugging the holes are to be filled with two plugs of matching or similar mattress material that are sold as an integral part of the mattress. Likewise a bottom fitted sheet with two pockets that match the holes and two small sheets for the plugs along with matching pillowcases will be sold with the mattress.

IN THE DRAWINGS

The accompanying drawings further describe the invention.

DETAILED DESCRIPTION OF THE INVENTION

Figure 1:
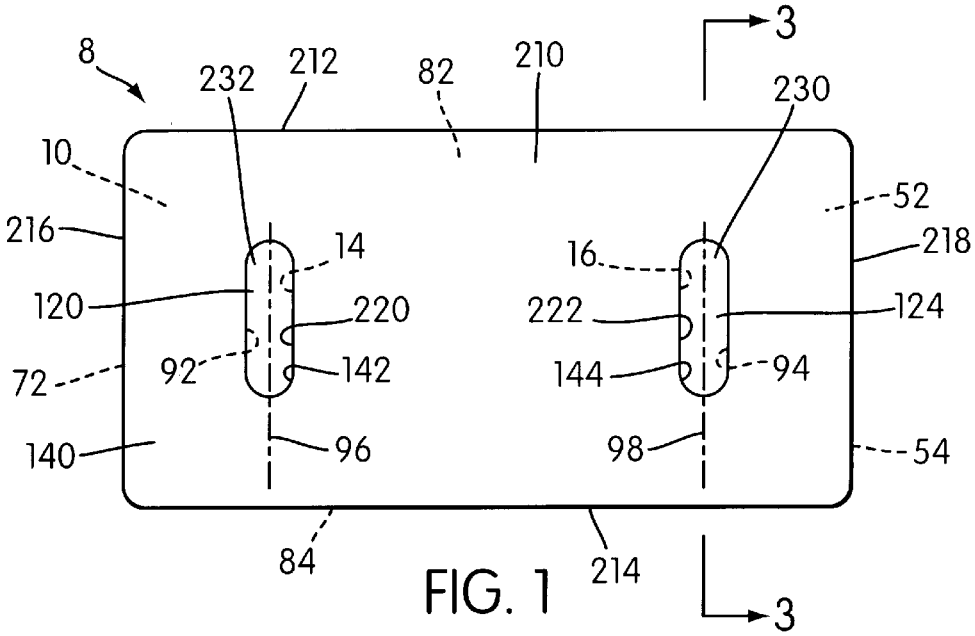
FIG. 1 shows a plan view looking down on the hugging mattress and showing the novel addition of two holes with filler plugs. The plugs can either be full or half depth of the mattress resulting in two or four plugs respectively.
Figure 2:
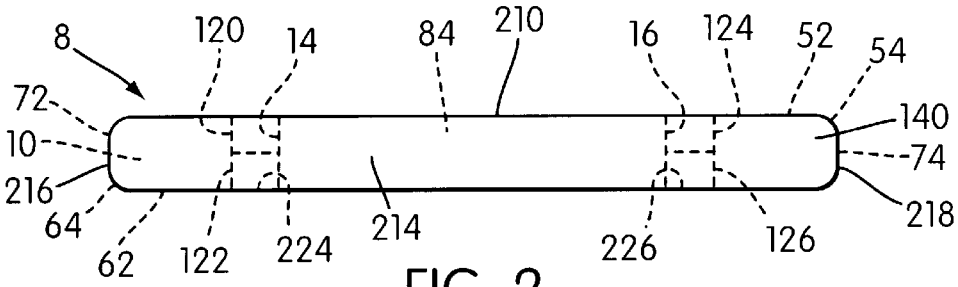
FIG. 2 shows a side elevation of the mattress with the plugs in place.
Figure 3:
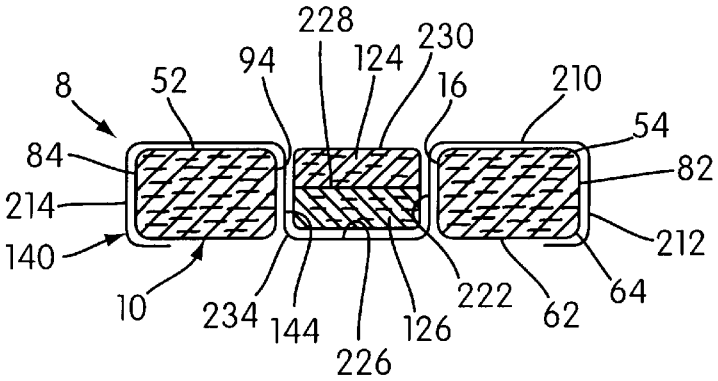
FIG. 3 shows a cross-sectional view of the mattress taken along line 3—3 in FIG. 1 and shows the plugs removed and a fitted sheet with two pockets to match the holes in the mattress.

This invention includes the addition of two holes 14 and 16 to the construction of any normal mattress for sleeping on a bed. The purpose for the holes 14 and 16 is to allow either or both persons to hug their bedmate for extended periods, or even all night long, with their lower arm without the normal crushing pain from the weight of their partner. The two holes 14 and 16, symmetrically located, permit the mattress 10 to be turned or flipped and also permit hugging one's bedmate in a head to toe position.

A mattress and sheet assembly 8 has a mattress 10 covered by a sheet 140. Mattress 10 has an upper surface 52 with a perimeter 54 and a lower opposite surface 62 with a perimeter 64. Mattress 10 also has two relatively shorter sides 72 and 74 and two relatively elongated sides 82 and 84. As with typical mattresses, the shorter sides 72 and 74 are generally parallel to each other and the elongated sides 82 and 84 are generally parallel to each other. The sides 72, 74, 82 and 84 are coupled to surfaces 52 and 62 along their respective perimeters 54 and 64.

Holes or passageways 14 and 16 extend completely through mattress 10 between the upper surface 52 and said lower surface 54. Hole 14 has a wall 92 extending between the upper surface 52 and the lower surface 62. Hole 14 is preferably oval or rectangular and has a longitudinal axis 96, which is preferably, approximately twenty inches from the shorter side 72. Longitudinal axis 96 is generally parallel to shorter side 72. Hole 16 has a wall 94 extending between the upper surface 52 and the lower surface 62. Hole 16 is preferably oval or rectangular and has a longitudinal axis 98, which is preferably, approximately twenty inches from the shorter side 74. Longitudinal axis 98 is generally parallel to shorter side 74. Therefore, holes 14 and 16 are symmetrically positioned on each surface 52 and 62 so that the mattress 10 gives the same effect for the user regardless of which side or orientation of the mattress is used.

The hugging mattress 10 is to be provided with two full depth or four half-depth plugs 120, 122, 124 and 126 to fill the holes 14 and 16 if desired when not used for hugging. This will make it safe for children jumping on the bed, for example. The plugs 120, 122, 124 and 126 will be of the same or similar mattress material or foam filled. Each hugging mattress 10 will also be accompanied by a fitted bottom sheet 140 with two pockets or slots 142 and 144 matching the said holes.

Fitted bottom sheet 140 has a main portion 210, two elongated side portions 212 and 214, and two short side portions 216 and 218. Each pocket or slot 142 and 144 has a wall and a bottom to form a closed pocket opened towards the top of the mattress while being closed towards the bottom of the mattress. In particular, pocket 142 has a slot wall 220 and a bottom 224 that is attached at its perimeter to the slot wall 220. Likewise, pocket 144 has a slot wall 222 and a bottom 226, which is attached to slot wall 222 at its perimeter 234. Each plug 120, 122, 124 and 126 has a plug sheet. Specifically, with respect to plugs 120, 124 and 126, plug 120 has a plug sheet 228, plug 124 has a plug sheet 230 and plug 126 has a plug sheet 232.

The drawings show the approximate size, shape and spacing of the holes but the essence is that they will be arranged to allow comfortable hugging of ones bedmate for extended periods of time. Extra padding of will be required around the edges of holes 14 and 16 to soften corners. Also the holes shall not be so large as to materially interfere with sleeping in the normal positions when not hugging a bedmate.

It is proposed that the hugging mattress 10 be manufactured, by the simple addition of the sewing machine necessary to sew the hugging mattress liner and cover around the holes and the fabrication of the two or four removable plugs 120, 122, 124 and 126.

What is claimed is:

1. A mattress assembly, comprising:

a mattress including an upper surface having a perimeter, a lower surface having a perimeter and being opposite said upper surface, two substantially parallel elongated sides, two substantially parallel short sides, said two elongated sides and said two short sides coupling said upper and lower surfaces around said perimeter of said upper surface and said perimeter of said lower surface, and an elongated first passageway extending completely through said mattress between said upper surface and said lower surface, said first passageway having a wall extending between said upper and said lower surfaces and defining said first passageway and a first longitudinal axis extending substantially parallel to said two short sides; and a removable, fabric sheet extending over said upper surface of said mattress, said sheet including a main portion, two elongated side portions coupled to and extending transversely from said main portion and extending over said elongated sides of said mattress and two short side portions coupled to and extending from said main portion and extending over said short sides of said mattress, said sheet further having an elongated first slot spaced from said elongated side portions and said short side portions of said sheet and positioned within said first passageway, said first slot having a first slot wall which is transverse to said main portion and positioned adjacent to and covering said wall of said mattress, and said first slot further having a first bottom which is coupled to said first slot wall and substantially parallel to and spaced from said main portion.

2. A mattress assembly according to claim 1, further comprising:

a first plug adapted to be inserted into said first passageway, and a first plug sheet positioned over said first plug.

3. A mattress assembly according to claim 2, further comprising:

a second plug adapted to be inserted into said first passageway, and a second plug sheet positioned over said second plug.

4. A mattress assembly according to claim 1, wherein:

said mattress includes an elongated second passageway extending completely through said mattress between said upper surface and said lower surface, said second passageway and said first passageway having a wall extending between said upper and said lower surfaces and defining said passageway and a second longitudinal axis extending substantially parallel to said two short sides, and said sheet including an elongated second slot positioned within said second passageway, said second slot having a second slot wall which is transverse to said main portion and positioned adjacent to and covering said wall of said mattress, and said second slot further having a bottom which is coupled to said second slot wall and substantially parallel to said main portion.

5. A mattress assembly according to claim 4, wherein said first and second passageways are symmetrically positioned on each of said upper and lower surfaces.

6. A fabric sheet, comprising:

a main portion having a top surface facing in a first direction and bottom surface facing in a second, opposite direction;

two elongated side portions coupled to and extending transversely from said main portion;

two short side portions coupled to and extending transversely from said main portion;

an elongated first slot spaced from said elongated side portion and said short side portion, said first slot having a first slot wall which is transverse to said main portion and a first slot bottom which is coupled to said first slot wall and substantially parallel to and spaced from said main portion, said first slot bottom having a perimeter attached to said first slot wall and said first slot bottom closing said first slot such that said first slot being open in said first direction while being closed in said second direction.

7. A fabric sheet according to claim 6, wherein said first slot has a first longitudinal axis extending substantially parallel to each of said two short side portion.

8. A fabric sheet according to claim 7, further comprising:

an elongated second slot spaced from said elongated side portions and said short side portions, said second slot having a second slot wall which is transverse to said main portion and a second bottom which is coupled to said second slot wall and substantially parallel to and spaced from said main portion.

9. A fabric sheet according to claim 8, wherein said first slot has a first longitudinal axis extending substantially parallel to each of said two short side portion, and said second elongated slot has a second longitudinal axis extending substantially parallel to each of said two short side potions.

10. A fabric sheet according to claim 9, wherein said first and second passageways are symmetrically positioned on said main portion.

11. A method of using a mattress comprising the steps of:

providing a mattress including an upper surface having a perimeter; a lower surface having a perimeter and being opposite said upper surface two substantially parallel elongated sides; two substantially parallel short sides, said two elongated sides and said two short sides coupling said upper and lower surfaces around said perimeter of said upper surface and said perimeter of said lower surface; an elongated first passageway extending completely through said mattress between said upper surface and said lower surface, said first passageway having a first wall extending between said upper and said lower surfaces and defining said first passageway and a first longitudinal axis extending substantially parallel to said two short sides; and an elongated second passageway extending completely through said mattress between said upper surface and said lower surface, said second passageway having a second wall extending between said upper and said lower surfaces defining said passageway and a second longitudinal axis extending substantially parallel to said two short sides, and said first and second passageways being symmetrically positioned on said upper and lower surfaces;

using said mattress, including a user lying down on said upper surface and extending an arm into said first passageway;

rotating said mattress 180 degrees in a first direction;

using said mattress, including a user lying down on said upper surface and extending an arm into said second passageway.

12. A method according to claim 11, further comprising the steps of:

rotating said mattress 180 degrees in a second direction;

using said mattress, including a user lying down on said lower surface and extending an arm into said second passageway.

13. A method according to claim 12, wherein the steps of rotating said mattress 180 degrees in a second direction and using said mattress, including a user lying down on said lower surface and extending an arm into said second passageway occur before said steps of rotating said mattress 180 degrees in a first direction and using said mattress, including a user lying down on said upper surface and extending an arm into said second passageway.

14. A method according to claim 11, further comprising the step of:

prior to using said mattress, including a user lying down on said upper surface and extending an arm into said first elongated passageway, placing a removable, fabric sheet on said upper surface of said mattress.

15. A method according to claim 11, further comprising the step of:

providing a fabric sheet having a main portion, two elongated side portion coupled to and extending transversely from said main portion, two short side portions coupled to and extending transversely from said main portion; an elongated first slot spaced from said elongated side portion and said short side portion, said first elongated slot having a first slot wall which is transverse to said main portion and a first bottom which is coupled to said first slot wall and substantially parallel to and spaced from said main portion; and prior to using said mattress, including a user lying down on said upper surface and extending an arm into said first elongated passageway, placing said sheet on said upper surface of said mattress.

* * * * *